US005595674A

United States Patent [19]

Kim

[11] Patent Number: 5,595,674

[45] Date of Patent: Jan. 21, 1997

[54] MICROWAVE OVEN WITH POWER SWITCHING CONTROLLER

[75] Inventor: Bae-Jin Kim, Kyungsangnam-Do, Rep. of Korea

[73] Assignee: LG Electronics Inc., Rep. of Korea

[21] Appl. No.: 519,432

[22] Filed: Aug. 25, 1995

[30] Foreign Application Priority Data

Aug. 29, 1994 [KR] Rep. of Korea ..... 21425/1994

[51] Int. Cl.[6] ..... H05B 6/68

[52] U.S. Cl. ..... 219/715; 219/721; 219/723

[58] Field of Search ..... 219/721, 715, 219/716, 702, 723, 720

[56] References Cited

U.S. PATENT DOCUMENTS

| | | | |
|---|---|---|---|
| 4,232,210 | 11/1980 | Oida et al. | 219/721 |
| 4,481,393 | 11/1984 | Ueda | 219/721 |
| 4,533,810 | 8/1985 | Harmon et al. | 219/721 |
| 4,719,326 | 1/1988 | Yoo | 219/721 |
| 4,987,556 | 1/1991 | Aoki | 219/715 |

*Primary Examiner*—Philip H. Leung
*Attorney, Agent, or Firm*—Ostrolenk, Faber, Gerb & Soffen, LLP

[57] ABSTRACT

An improved controller for a microwave oven capable of preventing it from an undesired heating caused by an erroneous operation thereof, which includes a heating member for generating heating energy; a power switch for controlling electric power supply to the heating member; a switch module including a plurality of switches for selecting a desired function; a microcomputer for outputting scanning signals having predetermined time differences to the switch module and for outputting a predetermined control signal in accordance with a key input signal outputted from the switch module; and a controller for controlling the power switch in accordance with control signals outputted from the microcomputer and a signal applied from the switch module, wherein the control signals includes a latch signal maintaining a predetermined state after the output signal of a switch is detected, while having the same level as a scanning signal outputted from a switch which is selected by an operation mode corresponding to scanning signals outputted from the switch module, and a power control signal which is transferred from a first state to a second state after the latch signal becomes a predetermined state and another predetermined time is lapsed while maintaining the first state.

2 Claims, 7 Drawing Sheets

CONVENTIONAL. ART

INTO

SN1

SN2

SN3

SN4

SW1

LATCH
TRIGGER LEVEL

POINT A

PWR

RELAY
COIL 63

INTO

SN1

SN2

SN3

SN4

SW2, SW3

LATCH

POINT A

PWR

RELAY
COIL 63

MICROWAVE OVEN WITH POWER SWITCHING CONTROLLER

BACKGROUND OF THE INVENTION

1. Field of the Invention

The present invention relates to a controller for a microwave oven, and in particular to an improved controller for a microwave oven capable of preventing an erroneous operation thereof causing an undesired heating.

2. Description of the Conventional Art

Generally, it is well known to use a programmable type controller such as a microcomputer so as to control various functions of a microwave oven. However, in the microcomputer, a runaway situation—that is, when the microcomputer is over-loaded by noise—may occur, so that electric power is erroneously supplied to heating elements due to malfunction or the like of the program counter in the microcomputer.

Referring to FIG. 1, a conventional controller for a microwave oven includes an alternating current source 10 for supplying electric power to corresponding elements and power controllers 11 and 12 for controlling the power supply. In addition, a lamp 13 is provided for lighting the interior of a heating chamber (not shown), and a fan motor 14 is provided for driving a fan (not shown) so as to cool a magnetron 19. A transformer 16 is provided to convert electric power into a sufficiently high voltage for driving the magnetron 19 as the electric power is supplied to a primary winding 15 of the transformer 16. A main secondary winding 17, of which its one side is connected to a filament of the magnetron 19 through the capacitor 20 and its other side is connected to a ground, and a sub-secondary winding 18, of which both terminals thereof are connected to the filament of the magnetron 19, supply high voltage of the transformer 16 to the magnetron 19. The magnetron 19 generates a desired energy as the high voltage is supplied thereto from the main- and sub-secondary windings through the above mentioned filament. The capacitor 20 is connected between the main secondary winding 17 and the filament of the magnetron 19 and increases the voltage level of the main secondary winding 17. A diode 21 is connected between the common node of the capacitor 20 and magnetron 19 forming a parallel path with the main secondary winding 17 for preventing the over current voltage in the main secondary winding 17. The electric power controllers 11 and 12 include relay switches 22 and 24, which are driven by relay coils 23 and 25. The relay coil 23 is switched to a DC power supply 26 through a series circuit of a thyristor 29 and a transistor 37, and the relay coil 25 is switched to DC power supply 26 through the transistor 40. In addition, the diodes 27 and 28 are parallely connected with the coils 23 and 25, respectively, for preventing excess current through of the coils 23 and 25. A resistor 31 is connected between the cathode and the gate of the thyristor 29. A resistor 32 and a diode 33 are connected in series between the gate of the thyristor 29 and the start switch 34, in order. A point between the diode 33 and the start switch 34 is connected to an input terminal IN of the microcomputer 30, and the other side of the start switch 34 is connected to a scanning signal output terminal SCN of the microcomputer 30. The base of the transistor 37 is connected to a start signal output terminal S of the microcomputer 30 through the resistor 35, and a resistor 36 connects between the base of the transistor 37 to ground. Here, the thyristor 29 and the transistor 37 form a switching circuit for controlling the supply of electric power supply to the relay coil 23. The base of the transistor 40 is connected to a power control output terminal PWR of the microcomputer 30 through a resistor 38, and a resistor 39 connects the base of the transistor 40 to ground. In addition, there is provided a speaker controller 42 for controlling a speaker 43 in accordance with a signal outputted from an alarm signal output terminal AL of the microcomputer 30, and a display unit 41 for displaying cooking time etc. in accordance with a signal outputted from a display signal output terminal D of the microcomputer 30. The above-described construction corresponds to that disclosed in U.S. Pat. No. 4,481,393 which is incorporated herein by reference.

The operation of the conventional controller for a microwave oven will now be explained with reference to FIGS. 2 and 3.

To begin with, pulse signals 50 through 54 each having a constant duty cycle are outputted from the scanning signal output terminal SCN of the microcomputer 30 as shown in FIG. 2A. The pulse signals 50 through 54 are applied to the gate of the thyristor 29 and the input terminal IN of the microcomputer 30 when the start switch 34 is turned on as shown in FIG. 2B. The microcomputer 30 on receiving the scanning signals detects whether at least two serial pulse signals are inputted thereto so as to avoid an erroneous operation. If the serial pulse signals are detected, the microcomputer 30 checks whether the door of the microwave oven is opened or closed and whether a predetermined heating time is set. As a result, if there is not an abnormal state, the microcomputer 30, as shown in FIG. 2D, outputs a start signal at the time c3 through the start signal output terminal S. In addition, after a predetermined time B is lapsed, at the time c4, the microcomputer 30 checks the signal level inputted to the input terminal IN' at from the point Q. In FIGS. 2A through 2G, since the thyristor 29 is in a cut-off state at the time c4 and thus the signal level at Q becomes a high level voltage, the microcomputer 30 stops the generation of the start signals and stops the heating operation. If the state at the point Q is a high level, the microcomputer does not generate the start signals. In this case, if the relay 23 maintains tire cut-off state continuously, the output signal of the alarm signal terminal AL maintains the cut-off state continuously. However, if the start switch 34, as shown in FIG. 3B, remains turned on for the time c1 through c5, the thyristor 29 becomes conductive by a pulse 53, and the signal level at the point Q becomes low level at the time c4. Therefore, the start signal is generated continuously after the time c4, and the heating operation can be performed.

The power control signal PWR can not be generated before a predetermined time B. If the microcomputer 30 recognizes that the signal level at the point Q is a low level at the time c4, a power control signal is outputted from the power control terminal PWR. However if, at the time c4, the level at the point Q is a high level, the power control signal is not generated, and the relay switch 24 is not closed. At this moment, it means that even if the relay switch 22 is closed because of its malfunction, when the electric potential at the time c4 is a high level, the magnetron 19 is not operational. However, if the microcomputer 30 recognizes that an electric potential at the point Q is a low level, it outputs a pulse signal through the alarm signal terminal AL, and therefore the speaker 43 becomes activated, and the microcomputer 30 displays on the display member 41 that the heating time is counted down. Therefore, when the heating time shown on the display 41 is zero, the microcomputer 30 stops the heating operation.

However, the conventional controller for a microwave oven has disadvantages in that it is directed to turning on a power relay by using only a start switch, so that when a plurality of switches for operating a heating instrument is adopted thereto, each switch disadvantageously requires its corresponding switch controller. In addition, in order to vary the voltage level, it is required to turn on and turn off one relay, while turning on another relay, so that it needs at least two relays. Moreover, unless the relay operating circuit is connected with a switch (for example a door switch) having direct contacts therebetween in series, when the door of the microwave oven is opened, a heating operation of the microwave oven can be erroneously performed.

SUMMARY OF THE INVENTION

Accordingly, it is an object of the present invention to provide a controller for a microwave oven, which overcomes the problems encountered in the conventional controller for a microwave oven.

It is another object of the present invention to provide an improved controller for a microwave oven capable of preventing an undesired heating operation caused by an erroneous operation thereof.

To achieve the above objects, there is provided a controller for a microwave oven which includes a heating member for generating heating energy; a power switch for controlling electric power supply to the heating member; a switch module including a plurality of switches for selecting a desired function; a microcomputer for outputting scanning signals having predetermined time differences to the switch module and for outputting a predetermined control signal in accordance with a key input signal outputted from the switch module; and a controller for controlling the power switch in accordance with control signals outputted from the microcomputer and a signal applied from the switch module, wherein the control signals includes a latch signal maintaining a predetermined state after the output signal of a switch is detected, while having the same level as a scanning signal outputted from a switch which is selected by an operation mode corresponding to scanning signals outputted from the switch module, and a power output signal which is transferred from a first state to a second state after the latch signal becomes a predetermined state and another predetermined time is lapsed while maintaining the first state.

DETAILED DESCRIPTION OF THE INVENTION

Figure 1:
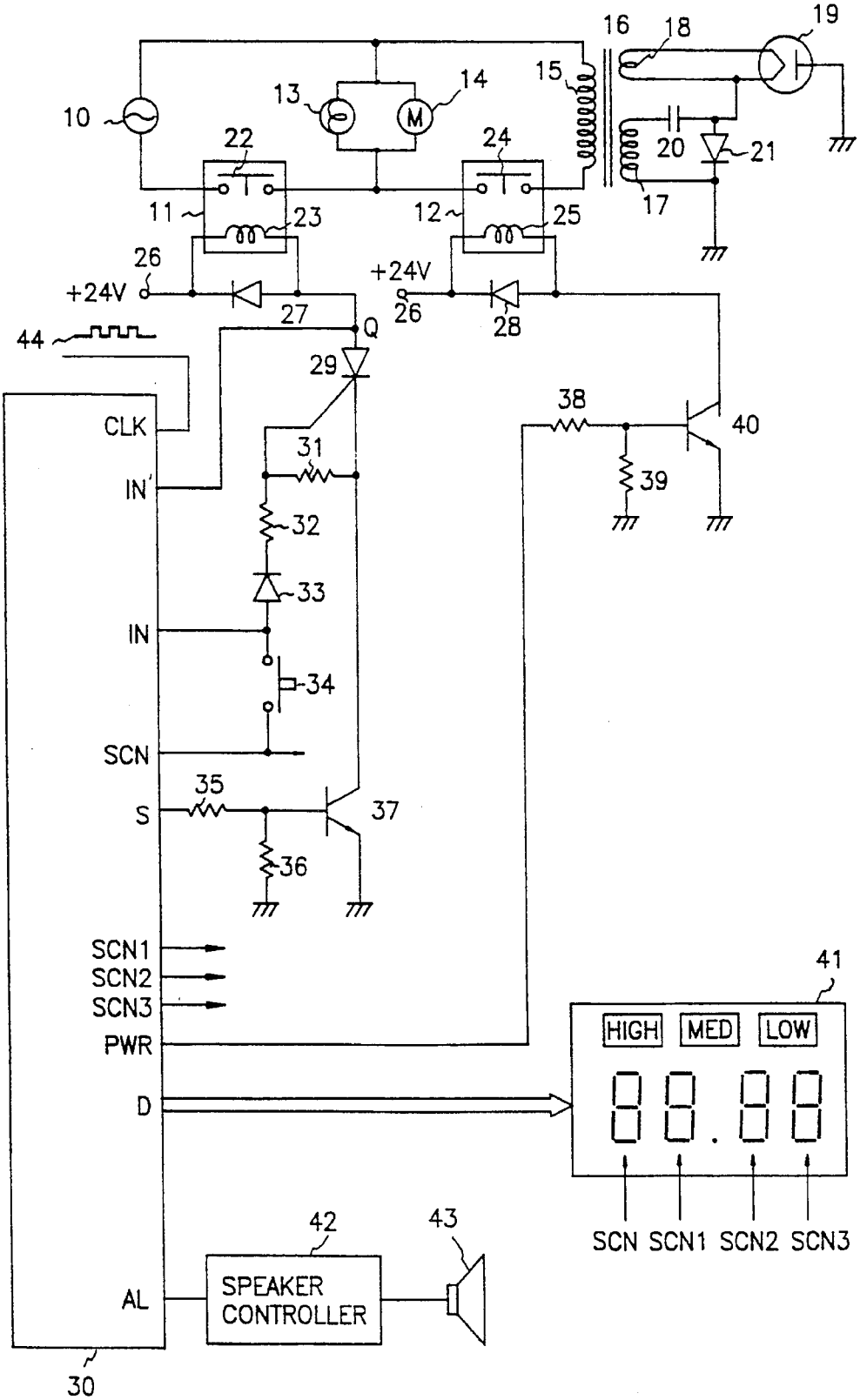
FIG. 1 is a schematic circuit diagram of a controller of a conventional microwave oven.
Figures 2A, 2B, 2C, 2D, 2E, 2F, 2G:
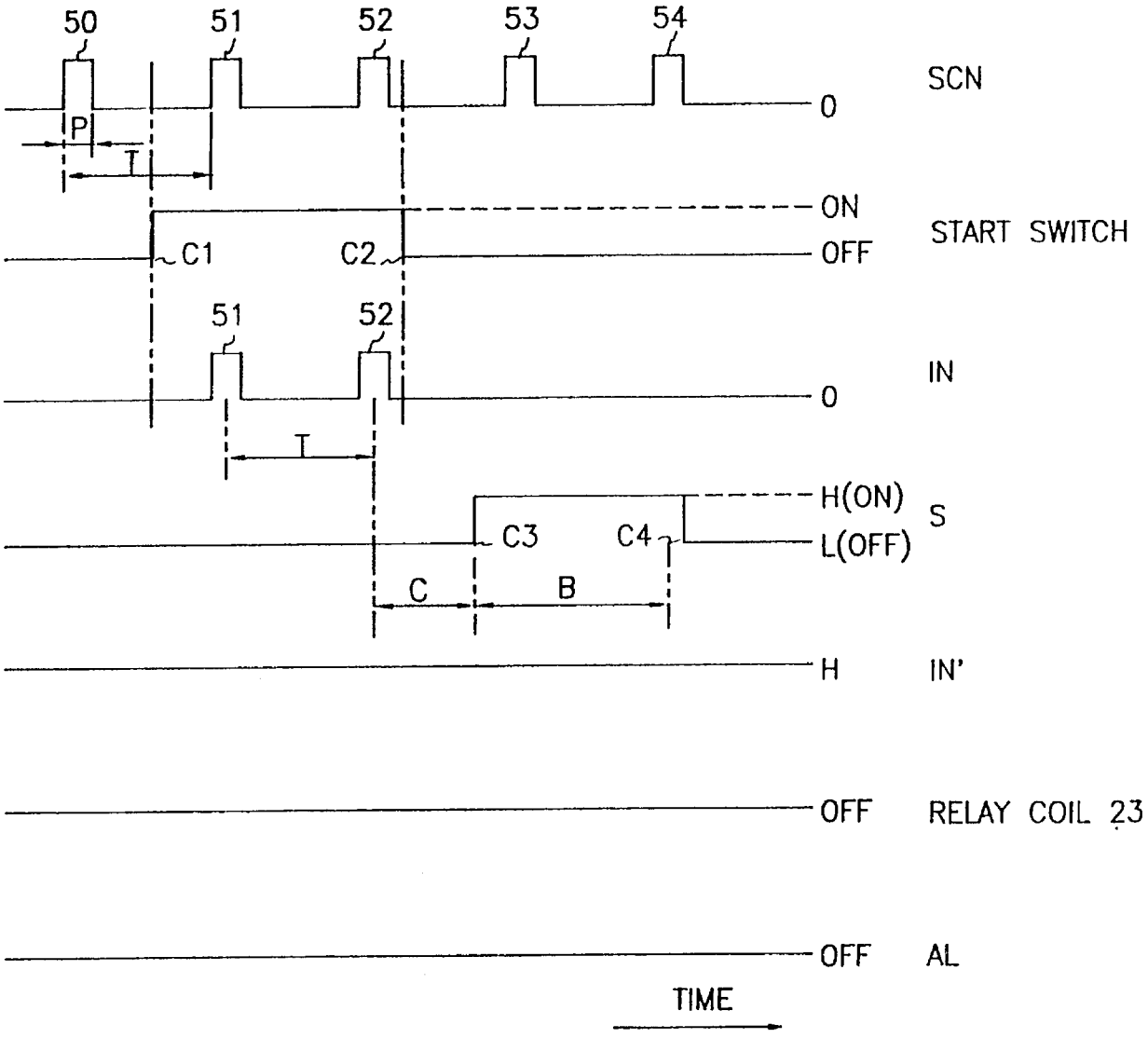
FIG.2A CONVENTIONAL ART
FIG.2B CONVENTIONAL ART
FIG.2C CONVENTIONAL ART
FIG.2D CONVENTIONAL ART
FIG.2E CONVENTIONAL ART
FIG.2F CONVENTIONAL ART
FIG.2G CONVENTIONAL ART
FIGS. 2A through 2G are diagrams showing wave-forms of corresponding elements of FIG 1.
Figures 3A, 3B, 3C, 3D, 3E, 3F, 3G:
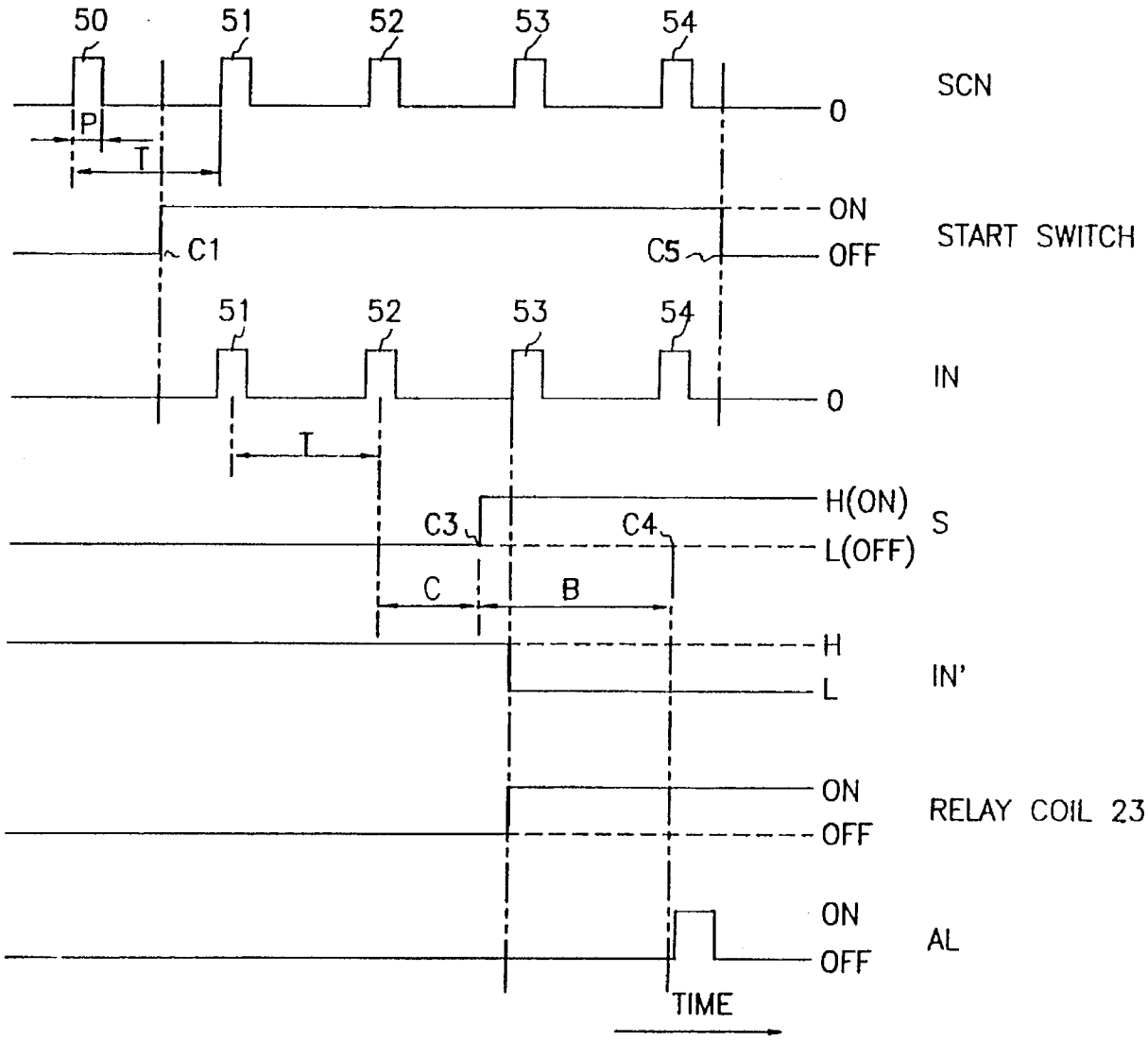
FIG.3A CONVENTIONAL ART
FIG.3B CONVENTIONAL ART
FIG.3C CONVENTIONAL ART
FIG.3D CONVENTIONAL ART
FIG.3E CONVENTIONAL ART
FIG.3F CONVENTIONAL ART
FIG.3G CONVENTIONAL ART
FIGS. 3A through 3G are diagrams showing wave-forms of corresponding elements of FIG. 1.
Figure 4:
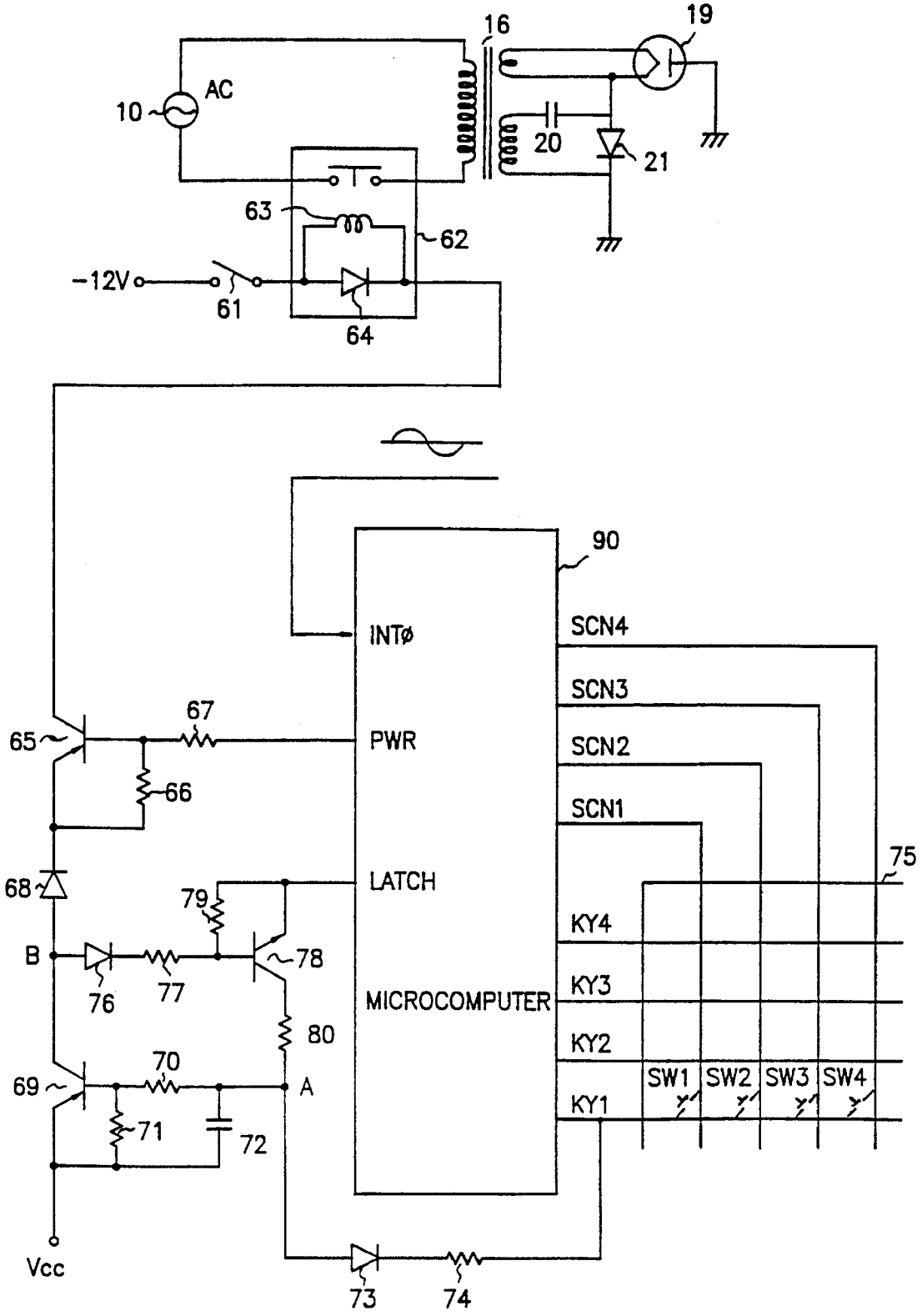
FIG. 4 is a circuit diagram of a controller of a microwave oven according to the present invention.

Referring to FIG. 4, an alternating current source 10, a transformer 16, a magnetron 19, a capacitor 20, and a diode 21 are provided in the controller of a microwave oven according to the present invention in the same manner as previously described for the conventional art. A switch 61 is opened or closed when the door of the microwave oven is opened or closed and thereby selectively switches the supply of direct current of −12 V. A relay 62 in which a coil 63 and a diode 64 are parallely connected to each other is provided for switching alternating current supply to the transformer 16. The control signal to the relay 62 is supplied from the collector of the transistor 65. A bias resister 66 is connected between the base and emitter of the transistor 65 and the base thereof os is connected to a power control terminal PWR of a microcomputer 90 through a base resistor 67 for switching the relay 62. The emitter of transistor 65 is connected to the collector of a transistor 69 through a reverse current blocking diode 68. The emitter of the transistor 69 is connected to a supply voltage Vcc, and the base thereof is connected to a node A through a resistor 70. A bias resistor 71 is connected between the base and the emitter of transistor 65. In addition, a capacitor 72 is connected between the node A, and the supply voltage. The node A is connected to a switch module 75, having a matrix construction for selecting a desired function of the microwave oven, through a diode 73 and a resistor 74. In addition, a node B between the collector of the transistor 69 and the reverse current block diode 68 is connected to the base of a transistor 78 through a reverse current blocking diode 76 and a base resistor 77 so as to latch the transistor 69. The base and the emitter of the transistor 78 are commonly connected by a bias resistor 79 and are connected to a latch terminal LATCH of the microcomputer 90, and the collector thereof is connected to the node A through a resistor 80. The microcomputer 90 includes an alternating input terminal INT for receiving an alternating synchronous signal, a power control terminal PWR for switching the transistor 65, a latch terminal LATCH for latching the electric power of the emitter of the transistor 78, key input terminals KY1 through KY4 for receiving key input signals, and scanning signal output terminals SCN1 through SCN4 for outputting scanning signals.

The operation of the controller for a microwave oven according to the present invention will now be explained.

Figures 5A, 5B, 5C, 5D, 5E, 5F, 5G, 5H, 5I:
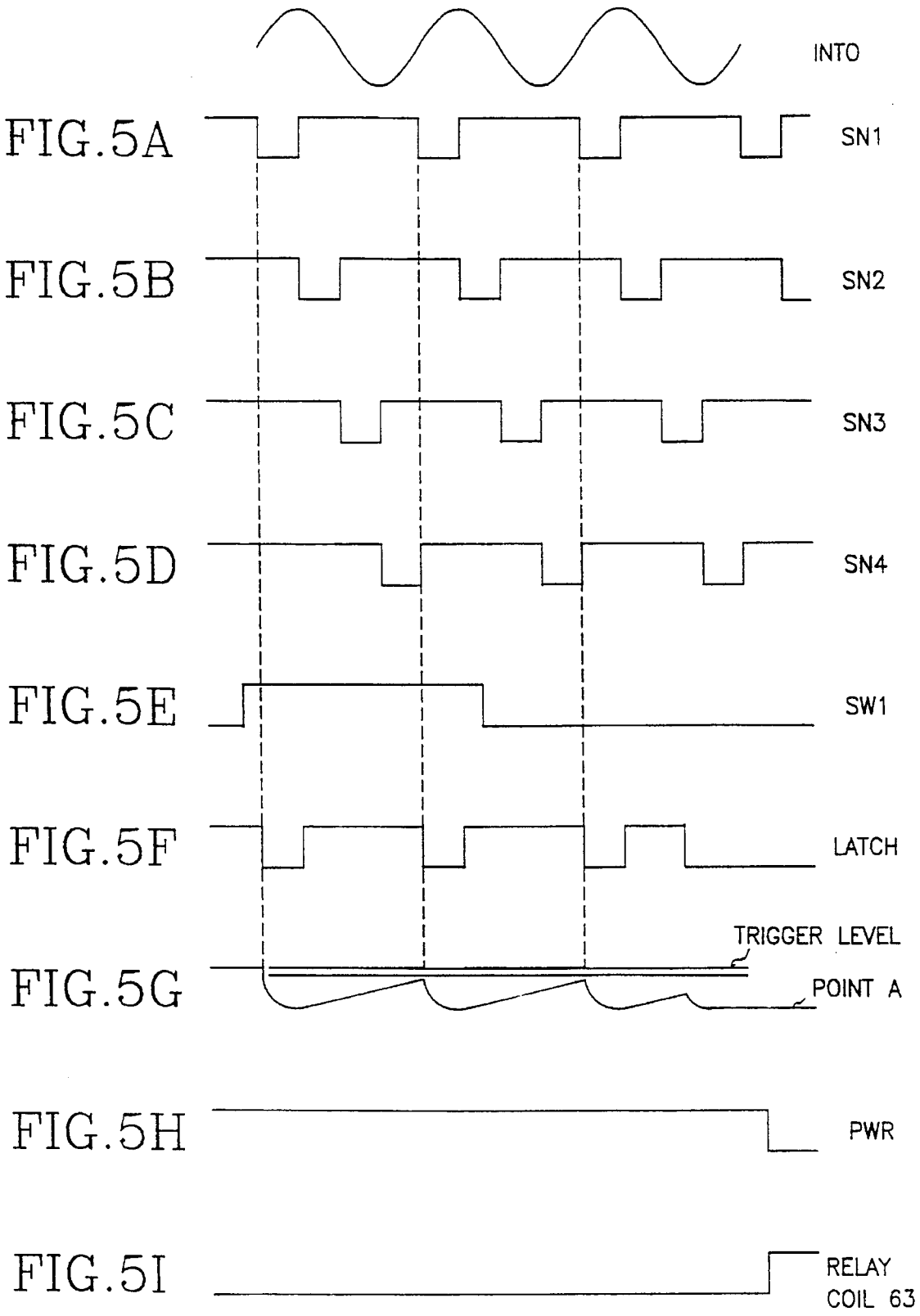
FIGS. 5A through 5I are diagrams showing wave-forms of corresponding elements of FIG. 4.
Figures 6A, 6B, 6C, 6D, 6E, 6F, 6G, 6H, 6I:
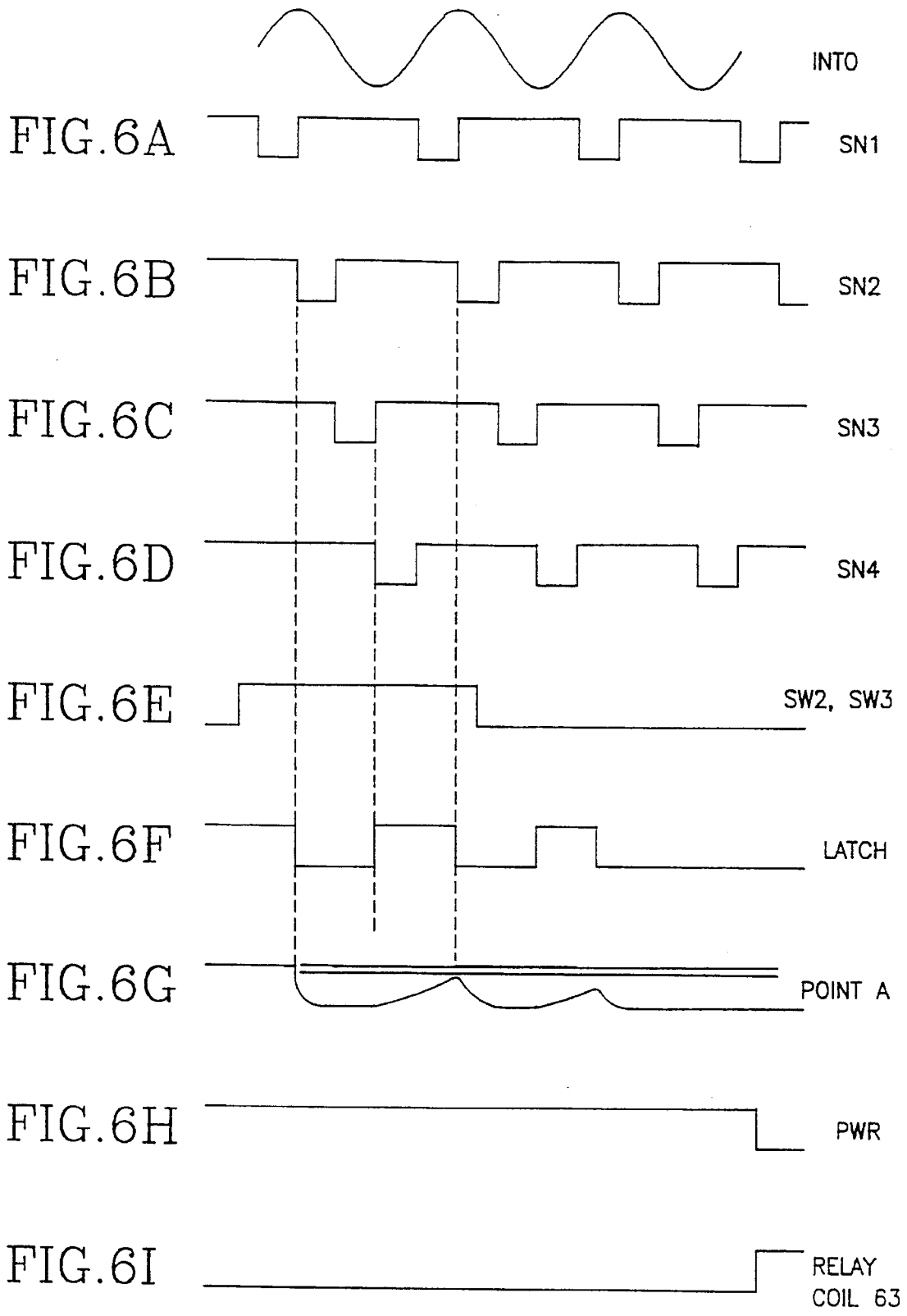
FIGS. 6A through 6I are diagrams showing wave-forms of corresponding elements of FIG. 4.

To begin with, the microcomputer 90 outputs scanning signals SN1 through SN4, each having a predetermined interval as shown in FIGS. 5A through 5I, to corresponding scanning output terminals SCN1 through SCN4 so as to scan the switch module 75. At this time, among the switches SW1, SW2, . . . SWn of the switch module 75, if a switch SW1 is in an input mode as shown in FIG. 5E, the microcomputer 90 outputs a signal having a wave-form shown in FIG. 5F to the latch terminal LATCH. At this moment, the wave-form of FIG. 5F is the same as the wave-form of FIG. 5A. In addition, among the switches of the switch module 75, if switches SW2 and SW3 are respectively in an input mode, the microcomputer 90 outputs signals SN2+SN3, shown in FIG. 6F, obtained by logically ORing the scanning signals SN2 and SN3, shown in FIGS. 6B and 6C, to the latch terminal LATCH. However, if among switches of the switch module 75 there is no input mode scanned from any switch, a constant high level signal is outputted from the latch terminal LATCH.

For example, when the switch SW1 is scanned in an input mode and is turned on as shown in FIG. 5E, a scanning signal having a wave-form shown in FIG. 5A outputted from the scanning signal output terminal SCN1 of the microcomputer 90 is inputted to the key input terminal KY1 through the switch SW1 and at the same time discharges the capacitor 72 to have a negative voltage. In addition, the voltage discharged in the above described manner is applied to the base of the transistor 69 through the resistor 70, and the transistor 69 is turned on. As the transistor 69 is turned on, the voltage Vcc is applied to the base of the transistor 78 through the transistor 69, the diode 76, and the resistor 77, and the transistor 78 is turned on. As the transistor 78 is turned on, the transistor 69 is latched to remain turned on since the capacitor 72 is discharged even though the switch SW1 is thereafter turned off. Here, the voltage at the node A connected to one side of the capacitor 72 has a wave form shown FIG. 5G based upon the wave-form shown FIG. 5A.

The microcomputer 90 detects the signal inputted to its key input port KY1 for checking whether an output signal of the switch SW1 is inputted. As a result, if the output signal of the switch SW1 is inputted, after a predetermined time K is lapsed, the microcomputer continuously outputs signals to a low level at the latch terminal LATCH. After a low level signal is outputted from the latch terminal LATCH, and after a predetermined time L is lapsed, the microcomputer 90 outputs a low level signal having a wave form shown in FIG. 5H at the power control terminal PWR. At this time, if the door of the microwave oven is closed, that is, if the door switch 61 is closed, the relay 62 is turned on as shown in FIG. 5I. In addition, the microcomputer 90 continuously outputs pulse signals having a constant duty cycle at the power control terminal PWR so that the microwave oven operates for the programmed time. Therefore, the transistor 65 is periodically turned on, and the voltage Vcc is supplied to the relay 62, and alternating current is supplied to the transformer 16. As voltage supplied to the secondary winding of the transformer 16 is supplied to the magnetron 19, the magnetron 19 begins oscillating. Therefore, the mode a user selected is executed. When the cooking operation is finished as the programmed time is lapsed, the microcomputer 90 outputs a high level signal at the power control terminal PWR and the latch terminal LATCH and turns off the transistors 78 and 65, respectively, and turns off the relay 62, so that the oscillation of the magnetron 19 ends.

Meanwhile, at the time of an input mode of the switches SW2 and SW3, the same operation as during the input mode of the switch SW1 is executed, and the wave-forms of signals at that time are shown in FIG. 6. That is, the present invention is directed to controlling the output level of a microwave oven using the relay 62.

Figure 7:
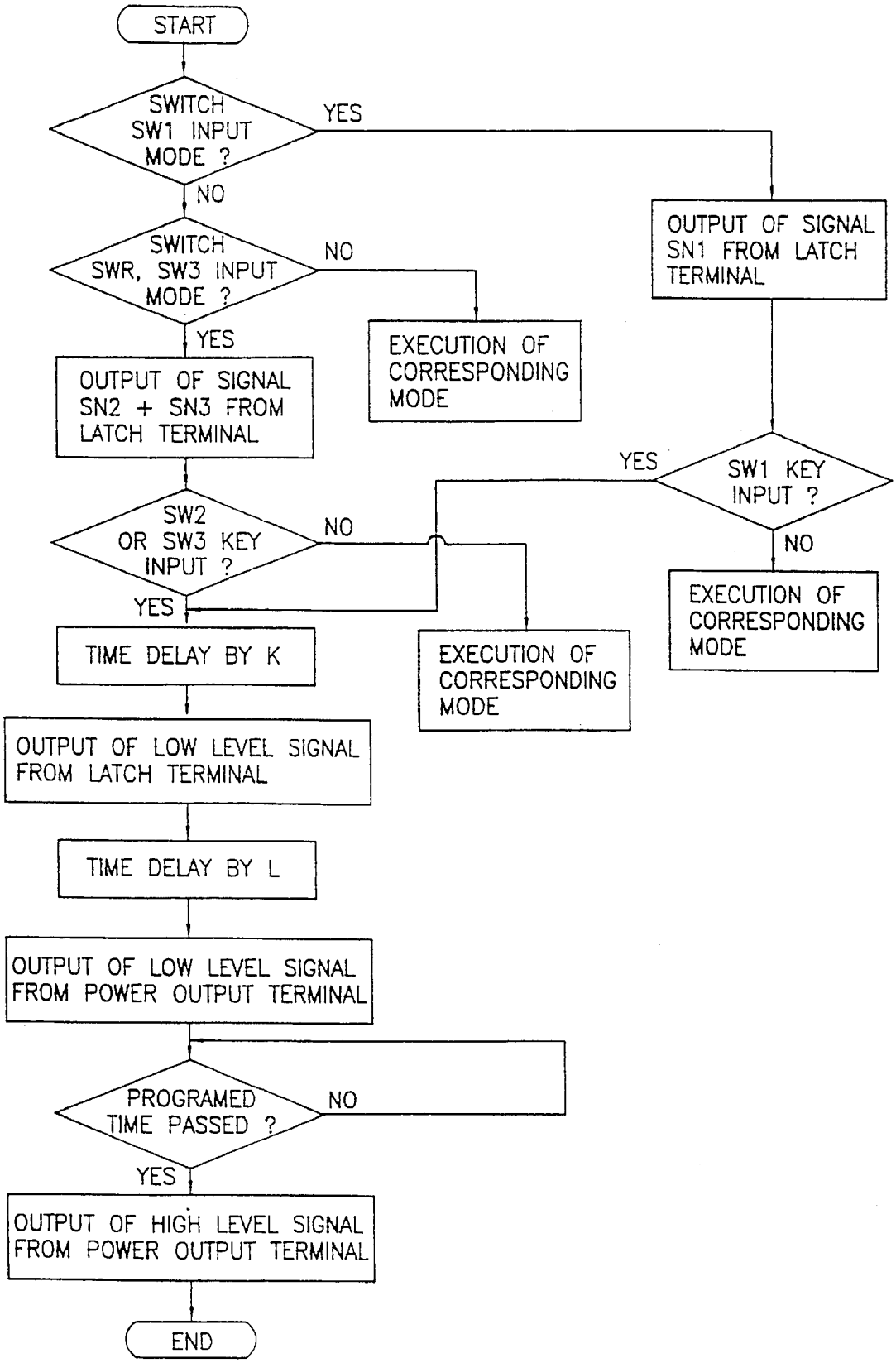
FIG. 7 is a flow chart of a controller of a microwave oven according to the present invention.

The operation of a program stored in the microcomputer to control a microwave oven will now be explained with reference to FIG. 7.

To begin with, if the switch module 75 of the microwave oven is scanned in an input mode of the switch SW1, the microcomputer 90 outputs the same signal as the scanning signal SN1 at the latch terminal LATCH. In addition, if the switch module 75 is scanned in an input mode of the switches SW2 and SW3, the microcomputer 90 outputs signals, which are the same as the signals SN2+SN3 which are obtained by logically ORing the scanning signals SN2 and SN3, at the latch terminal LATCH. The microcomputer 90 checks whether a switch among the switches SW1 through SW3 is turned on. As a result, if there is no turned-on switch, the corresponding mode is executed. If there is a turned-on switch, after a predetermined time K is lapsed, the microcomputer 90 outputs a low level signal at the latch terminal LATCH. After another predetermined time L, the microcomputer 90 outputs a low level signal at the power control terminal PWR. In addition, after a programmed time is lapsed, the microcomputer outputs high level signals at the power control terminal PWR and the latch terminal, respectively, and the magnetron oscillation operation stops.

As described above, according to the controller for a microwave oven of the present invention, there is no need to provide additional controllers for each switch in case that there are provided a plurality of switches for controlling the operation of the microwave oven. Instead, there is utilized only a single relay so as to control the microwave oven. In addition, the present invention has an advantage in that a relay driving circuit is connected with a door switch in series, so that in case that the microcomputer erroneously detects the open/closed state of the door, the microwave oven does not perform a heating operation.

What is claimed is:

1. A microwave oven with a power switching control circuit, comprising:

heating means for generating heat energy;

power switching means for controlling electric power supplied to said heating means;

switch module means including a plurality of switches for selecting a desired function and for outputting a key input signal;

microcomputer means for outputting scanning signals at predetermined time differences to said switch module means and for outputting predetermined control signals in accordance with the key input signal scanned from the switch module means; and control means for controlling said power switching means in accordance with the control signals outputted from said microcomputer and the key input signal outputted from the switch module means, the control means including:

a capacitor for carrying a charge in accordance with the key input signal outputted from the switch module means;

a first transistor for switching a supply voltage in accordance with the charge of said capacitor which charge is coupled to a base and an emitter of said first transistor;

a second transistor, which is turned on by an output signal from said first transistor being coupled to a base of said second transistor, for transferring a latch signal applied to an emitter of said second transistor from said microcomputer means to the capacitor through a collector of said second transistor; and a third transistor having an emitter coupled with the base of the second transistor and the collector of the first transistor, and operated by a power control signal from the microcomputer means applied to a base of said third transistor for controlling the operation of the power switching means by switching the supply voltage turned on by the first transistor, wherein said latch signal maintains a predetermined state after the key input signal of said switch module means which is selected and applied to the second transistor is detected, while having the same level as a scanning signal outputted from a switch of said switch module means which is selected by an operation mode corresponding to scanning signals outputted from the switch module means, and wherein the power control signal is changed from a first state into a second state after said latch signal becomes a predetermined state and a second predetermined time is lapsed while maintaining the first state.

2. The microwave oven with power switching control circuit of claim 1, further comprising a door switch, which is closed and opened when a door of the microwave oven is correspondingly closed and opened, the door switch being connected with the power switching means in series.

* * * * *